US010115257B2

(12) United States Patent
Abner

(10) Patent No.: US 10,115,257 B2
(45) Date of Patent: Oct. 30, 2018

(54) NETWORK CONNECTIVITY MODULE FOR ELECTRO-MECHANICAL LOCKS

(71) Applicant: Roy T. Abner, Lexington, KY (US)

(72) Inventor: Roy T. Abner, Lexington, KY (US)

(73) Assignee: Roy T. Abner, Lexington, KY (US)

( * ) Notice: Subject to any disclaimer, the term of this patent is extended or adjusted under 35 U.S.C. 154(b) by 0 days.

(21) Appl. No.: 15/696,356

(22) Filed: Sep. 6, 2017

(65) Prior Publication Data

US 2018/0108196 A1 Apr. 19, 2018

Related U.S. Application Data

(60) Provisional application No. 62/408,990, filed on Oct. 17, 2016.

(51) Int. Cl.
*G07C 9/00* (2006.01)
*E05B 47/00* (2006.01)
*E05B 65/00* (2006.01)

(52) U.S. Cl.
CPC ..... *G07C 9/00912* (2013.01); *G07C 9/00142* (2013.01); *G07C 9/00174* (2013.01);
(Continued)

(58) Field of Classification Search
CPC ..... G07C 2009/00841; G07C 9/00103; G07C 9/00817; G07C 2009/00388;
(Continued)

(56) References Cited

U.S. PATENT DOCUMENTS 5,477,213 A * 12/1995 Atarashi ..... G07C 9/00817 235/382.5
2004/0189439 A1 9/2004 Cansino
(Continued)

FOREIGN PATENT DOCUMENTS

WO 2016/157034 A1 10/2016

OTHER PUBLICATIONS

Notification of Transmittal of the International Search Report and the Written Opinion of the International Searching Authority, or the Declaration, for corresponding International Application No. PCT/US2017/050196, dated Jan. 9, 2018, 16 pages.

*Primary Examiner* — Dionne H Pendleton
(74) *Attorney, Agent, or Firm* — Myers Bigel, P.A.

(57) ABSTRACT

A network connectivity module may provide additional or alternative functionality to a lock that secures a securable container, such as a safe or automated teller machine. The module may be installed in a communication pathway between a keypad and the lock. The module may be programmed to communicate with a plurality of different locks manufactured by different manufacturers. The module may include a network input/output interface, which may provide a wired or wireless connection to one or more external networks, such as the Internet. The additional or alternative functionality may provide a new feature set for the lock that was not available at the time of purchase or installation of the lock. Additionally or alternatively, the connectivity to the external networks may enable remote access to the module, and may enable a remote user to enable or disable functionality of the module, and/or access to the securable container.

20 Claims, 6 Drawing Sheets

(52) U.S. Cl.
CPC ..... *G07C 9/00182* (2013.01); *G07C 9/00817* (2013.01); *E05B 47/0001* (2013.01); *E05B 65/0075* (2013.01); *G07C 2009/00753* (2013.01); *G07C 2009/00761* (2013.01); *G07C 2009/00825* (2013.01); *G07C 2009/00841* (2013.01); *G07C 2009/00849* (2013.01); *G07C 2209/10* (2013.01); *G07C 2209/62* (2013.01)

(58) Field of Classification Search
CPC ..... G07C 2009/00412; G07C 2009/00761; G07C 2009/00825; G07C 9/00309; G07C 9/00571; G07C 9/00904; G07C 2009/00753; G07C 2209/10; G07C 2209/62; G07C 9/00142; G07C 9/00912; G07C 9/00174; G07C 9/00182; G07C 2009/00849; E05B 2047/0091; E05B 47/00; E05B 47/0012; E05B 47/0001; E05B 65/0075; G06F 21/35; G06F 3/048; H04M 1/67; H04M 1/725; H04M 1/72533; H04M 1/72541; H04M 1/72569; Y10T 70/5562; Y10T 70/7028; Y10T 70/7062; Y10T 70/7107
See application file for complete search history.

(56) References Cited

U.S. PATENT DOCUMENTS

| | | | | |
|---|---|---|---|---|
| 2005/0179349 | A1 | 8/2005 | Booth et al. | |
| 2007/0204663 | A1* | 9/2007 | Lee | E05B 47/00 70/279.1 |
| 2011/0254658 | A1 | 10/2011 | Hui | |
| 2014/0215496 | A1* | 7/2014 | Sexton | G06F 3/048 719/318 |
| 2015/0332527 | A1 | 11/2015 | Pukari | |
| 2016/0035163 | A1 | 2/2016 | Conrad et al. | |
| 2016/0163140 | A1 | 6/2016 | Lagimodiere et al. | |
| 2018/0137704 | A1* | 5/2018 | Caterino | G07C 9/00817 |

* cited by examiner

NETWORK CONNECTIVITY MODULE FOR ELECTRO-MECHANICAL LOCKS

CROSS-REFERENCE TO RELATED APPLICATION

This application claims priority under 35 U.S.C. § 119 from U.S. Provisional Application Ser. No. 62/408,990, entitled "NETWORK CONNECTIVITY MODULE FOR ELECTRO-MECHANICAL LOCKS" and filed on Oct. 17, 2016, the entire disclosure of which is hereby incorporated by reference herein for all purposes as if set forth in its entirety.

FIELD

The present disclosure relates generally to electro-mechanical locks, and to providing network connectivity to electro-mechanical locks.

BACKGROUND

Locking devices, such as high-security locks, fall into two broad categories: mechanical, and electro-mechanical. Typically, both types of locks are mounted on safes or other securable containers to protect valuables stored therein. These valuables include currency, jewelry, important paperwork and documents, firearms and ammunition, and other high valuable personal and commercial property and effects. These securable containers may be found in retail stores, homes, banking locations, and many other locations.

Both electro-mechanical locks and mechanical locks have some sort of input device (such as a keypad or rotating dial) that is mounted on an outside of the securable container. The lock is typically mounted on an inside of the securable container. Commonly, the lock has a bolt that prevents opening of the container by inhibiting movement of the container's boltworks when the container is secured. For example, the bolt may extend from a door or access panel of the container into a frame of the container, and prohibit movement of the door or access panel when the lock is in a secured state. When the lock is placed in the unsecure state, by providing an acceptable input to the lock via the input device, the bolt may retract into the lock body and thereby allow entry to the interior of the secured container by movement of the door or access panel. Arrangements of the lock, bolt, and access panel may vary depending on the needs of the individual or organization that requires a secured area; the number of bolts may also be any number greater than one.

Mechanical and electro-mechanical locks typically mount on the container utilizing mounting hole pattern and spindle hole pattern that is common to the lock manufacturer. Mechanical locks may have a spindle that mechanically connects a dial to the lock through a small hole, typically less than half an inch, in the container. The dial may be mounted on the outside of the container over the small hole with a spindle (typically constructed of a threaded rod) passing through the hole and attaching to the lock directly on the other side of the hole in the secure area of the container. A combination or secret code is entered by rotating the dial in a sequence to specific numbers marked on the dial. As the dial rotates, the spindle rotates, thus rotating wheels inside the mechanical lock. When the correct combination is entered, the wheels inside the lock align in a way to allow the lock bolt to be retracted. Alternatively, a key may be provided to a keyhole at the outside of the box, which may raise different pins within the lock so as to move each pin out of the way of a tumbler, which can then rotate and allow the lock bolt to be retracted. Mechanical locks typically do not include any electronic components or firmware, and therefore are non-programmable, except that a specific combination may be set by setting the position of the mechanical wheels.

Electro-mechanical locks typically have a numeric keypad on the outside of the container and a multi-conductor cable connecting the keypad to the lock inside the container. In some instances the multi-conductor cable may pass through the spindle hole. The multi-conductor cable transmits power and communications between the keypad and lock. Because of the small diameter spindle hole in the container, the number of conductors in the cable is limited; typically to 4 conductors. Some electro-mechanical locks may also have spindles, in addition to the multi-conductor cable, connecting the keypad to the lock.

The keypad transmits signals indicative of key presses to the lock and when a correct code is entered, the lock will either retract the bolt or permit the bolt to be retracted. Electro-mechanical locks typically use small motors to move or unblock the bolt, or small solenoids to unblock the bolt.

SUMMARY

Aspects of the present disclosure provide various devices, systems, and methods, including a module configured to be installed between and connected to each of a locking device and a keypad. The module may include a processor and memory storing instructions. The instructions, when executed by the processor, may cause the processor to determine a set of features that the locking device and the keypad are programmed to perform, and execute at least one instruction to perform an additional feature that is not in the set of features and that the locking device and the keypad are not programmed to perform.

Aspects of the present disclosure also provide a module configured to be installed between a locking device and a keypad that includes a network interface, a processor, and memory storing instructions. The instructions, when executed by the processor, may cause the processor to: receive a command via the network interface, wherein the command indicates a feature that the locking device and the keypad are not programmed to perform independent of the module; and transmit a signal toward the keypad and/or the locking device based on the command and based on data stored in the memory.

Aspects of the present disclosure also provide a module configured to be installed between a locking device and a keypad that includes a network interface; a processor; and a memory storing a library comprising commands for locking devices manufactured by a plurality of manufacturers. The memory may also store instructions that when executed by the processor, cause the processor to: receive a command via the network interface requesting performance of a feature; access the library to retrieve at least one first instruction that is selected based on an indication of the feature and an indication of a manufacturer of the locking device; and perform the feature. Performing the feature may include executing the at least one first instruction. The library may include at least one second instruction for a different manufacturer that, if executed, performs the feature.

DETAILED DESCRIPTION

Figure 1:
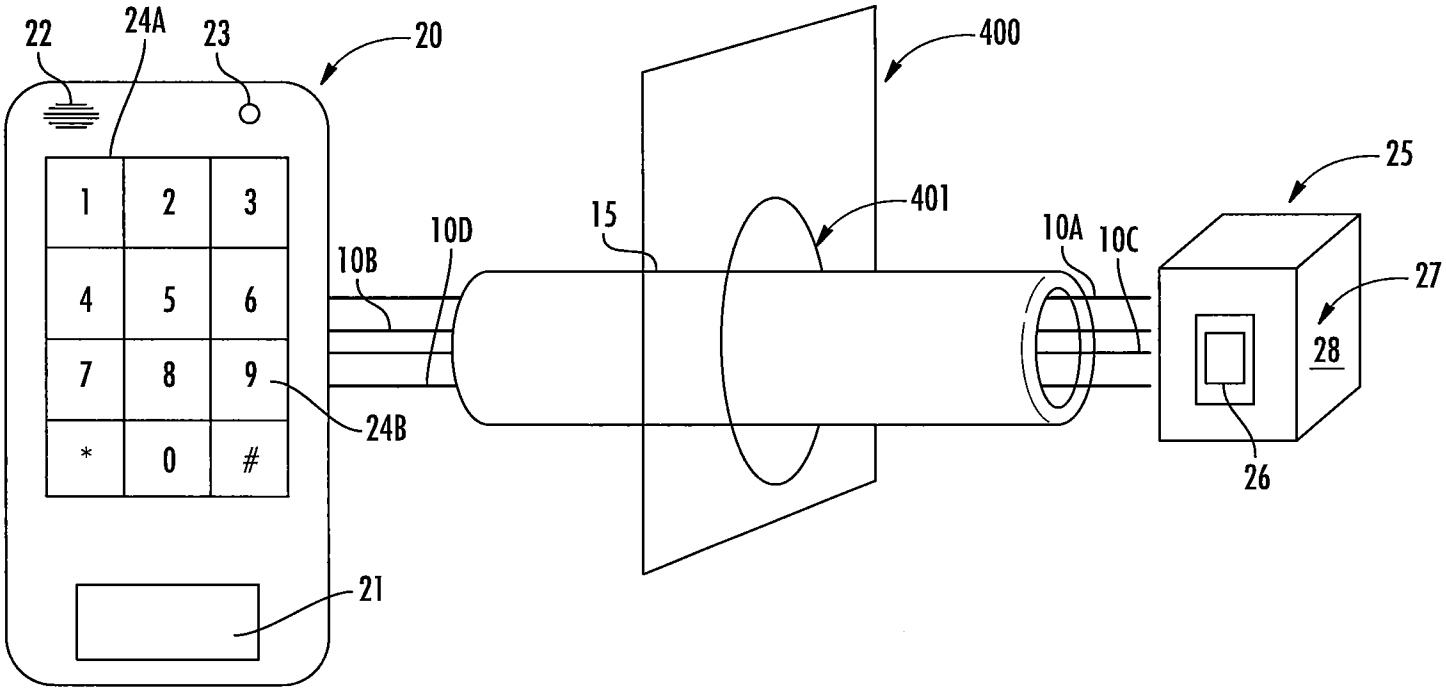
FIG. 1 illustrates an exemplary arrangement of a lock and keypad in which aspects of the present disclosure may be used.

It has been recognized by the inventor that electro-mechanical locks have numerous advantages over mechanical locks. For example, unlike a mechanical lock which may have only one keying or combination, an electro-mechanical lock may be programmed with many codes to open the lock. In some situations, these codes may provide different functionality: for example, a first code may allow both access to the secured container and the ability to program other access codes. A second code may allow access to the secured container only during a certain time of day and/or on a certain day of the week.

Electro-mechanical locks may also be programmed with selectable operating modes such as dual control (e.g., where two correct codes may be entered, in some cases by two different individuals, to open the lock) or supervisor/employee mode (where an employee access code will not open the lock until a supervisor access code has enabled it). Electro-mechanical locks may also include time delay, duress alarm, time lock and other features. For example, electro-mechanical locks may also deter unauthorized access by disabling for a period of time if too many consecutive incorrect codes have been entered. Typically, these are programmable by the owner of the lock or installation of the lock by a locksmith.

Other electro-mechanical locks, particularly ones used on automated teller machines (ATMs), utilize a one-time-code (OTC). An OTC may be a code that is usable once to open the lock and is typically limited to a particular time period in a specific day. For example, the OTC can be set to open the lock only between 12 noon and 4 PM on Oct. 17, 2016. Once the OTC is used to open the lock or the time window has expired, the OTC will no longer open the lock.

A number of products are being developed with connectivity to a wired or wireless network (e.g., a Wi-Fi network that provides connectivity to the Internet) as a feature. Some work in this field is being done within an ideology that all devices will eventually have network connectivity, creating an Internet-of-Things (IoT). Some manufacturers of high security locks have introduced models that are Internet-connectable. These products can typically be programmed and monitored remotely, offering further advantages. For example, an owner of a firearms safe may receive an email if the safe is opened while the owner is absent. As another example, an owner, operator, or manager of multiple retail store outlets may be able to remotely delete an employee's code from one or more safes if that employee quits or is terminated. As a third example, a central office of a retail bank can be notified if an ATM safe is opened expectantly or is left opened when it should be secured.

However, even with these advantages in mind, and with reference back to the background section, it has been recognized that there are many disadvantages from the perspective of the customer, including a customer with multiple secured containers.

One major disadvantage is that manufacturers are inconsistent with their implementations of electrical connectivity, programming, and functionality, both across lock models in a manufacturer's product catalog, and between manufacturers.

As a first example, it has been recognized that there is not an industry standard for the electrical connection between the lock and keypad. Each manufacturer may use different cabling, connectors, pins, and so on to connect the lock and the keypad. FIG. 1 illustrates an exemplary connection scheme, which may be used by one or more lock manufacturers, and which may utilize four conductors 10A, 10B, 10C, and 10D, in a cable 15 between a keypad 20 and lock 25. The cable may communicate through a small hole or aperture 401 in a wall of a securable container 400. Two of the conductors (e.g., 10A, 10B) may provide power to the lock 25 from one or more batteries (not shown), which may be installed in a compartment 21. In FIG. 1, compartment 21 is shown as a part of the keypad 20, but such location is merely exemplary and the battery or batteries may be installed, for example, in lock 25 or in a separate battery housing. As discussed below, in some aspects batteries may be optional, and instead a self-generating power technique may be used, with capacitors placed in compartment 21. The third conductor (e.g., conductor 10C) may provide an analog voltage from the keypad 20 to the lock 25, with a different voltage for each key press (e.g., depressing key 24A may result in a first analog voltage being communicated from the keypad 20 to the lock 25, and depressing key 24B may result in a second analog voltage being communicated from the keypad 20 to the lock 25). The lock may drive a beeper 22 and LED 23 in the keypad via the fourth conductor (e.g., conductor 10D) using an analog voltage to indicate to a keypad user status information (e.g., key press, lock status, correct code entry, incorrect code entry, or other status information).

Lock 25 may be a locking device and may include a body 28, and housed therein may include a locking mechanism 26, which may be a bolt that retracts into or extend from the body 28. Locking mechanism 26 may be driven by a bolt driving mechanism 27, which may include a powered actuator. The bolt driving mechanism may be electronically controllable and may be operable to actuate the locking mechanism between the locked position and the unlocked position based upon an electronic command. Sensors (not shown) may be present within lock 25 to determine a position of the locking mechanism (e.g., locked or unlocked).

Securable container 400 may be any type of container or closure to which access is intended to be restricted. For example, securable container 400 may be a vault or safe. In other aspects, securable container 400 may be a room, such as a garage, bedroom, wine cellar, ballroom, bathroom, or the like, and securing the securable container may include securing a door, window, gate, or the like with lock 25. In some aspects, securable container 400 may be a cabinet, dresser, gun safe, liquor cabinet, wine chiller, or the like to which access to contents therein may be restricted.

Although multiple manufacturers use the connection technique illustrated in FIG. 1, the analog voltage levels for each key of the keypad and the voltage levels of driving the beeper and LED are inconsistent across manufacturers.

A second identified example of a lack of consistency in the field is that manufacturers also have some models that use digital communications (e.g., digital voltages) instead of analog communications between the lock and keypad. In some models the digital communications is bidirectional over a single conductor (using either a time multiplexing scheme and/or frequency multiplexing scheme), while some models utilize two conductors for bidirectional communications. Messages or data sent or received over these communication channels may also be inconsistently implemented across manufacturers.

A third identified example of inconsistency in the field is that techniques for powering the locks may vary across manufacturers. Some products may use one or two 9 Volt (V) alkaline batteries, some products may use direct current (DC) power supplies, and some products may use a self-generating power technique. A self-generating power-technique may use a motor, such as a stepper motor, as a generator and may store power in capacitors for a period of time, typically long enough to open the lock. To open the lock, a user must quickly rotate a dial back and forth numerous times. The dial may be coupled to the shaft of the stepper motor and the stepper motor may be electrically connected to capacitors through a diode bridge. As the shaft of the stepper motor rotates, the motor may supply current into the capacitors to charge the capacitors with sufficient energy. Although this technique requires the user to charge the capacitors before opening the lock, it has the advantage of not having to replace batteries.

Fourth, manufacturers may, for cost or marketing purposes, implement different functionality in different product models. For example, a manufacturer may release a first lock with a first set of functionality and a second lock with a second set of functionality. Although these models may be initially selected by users for pricing purposes, adding or changing functionality later typically requires the installation of a different lock (e.g., the functionality is typically not changeable after installation). Moreover, for individuals or organizations with a large number of securable containers, the functionality available at each securable location may differ based on when the lock was installed.

Finally, although the introduction of Internet-connected locks to the field is interesting, there is little or no commonality between manufacturers of Internet-connected locks. Furthermore, as discussed in the preceding paragraph, the existing products in the field cannot be retrofitted or upgraded to have Internet connectivity.

With consideration of the identified problems in the field that have been newly recognized by the named inventor of the present application, and consideration of other problems that may become apparent upon review of the present application, aspects of the present disclosure are directed toward a network connected module described in detail herein.

Figure 2:
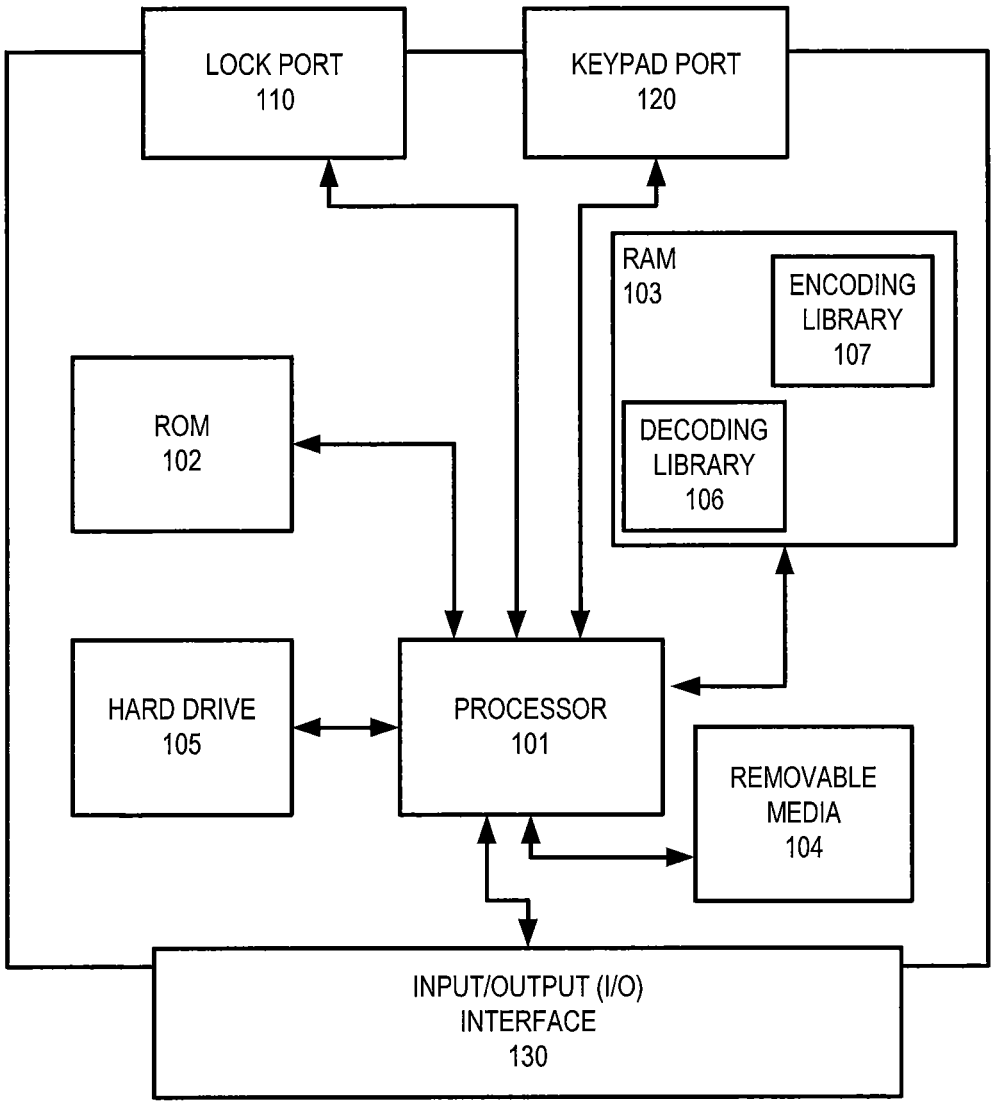
FIG. 2 illustrates a block diagram of a network connectivity module for electro-mechanical locks, according to aspects described herein.
Figure 3:
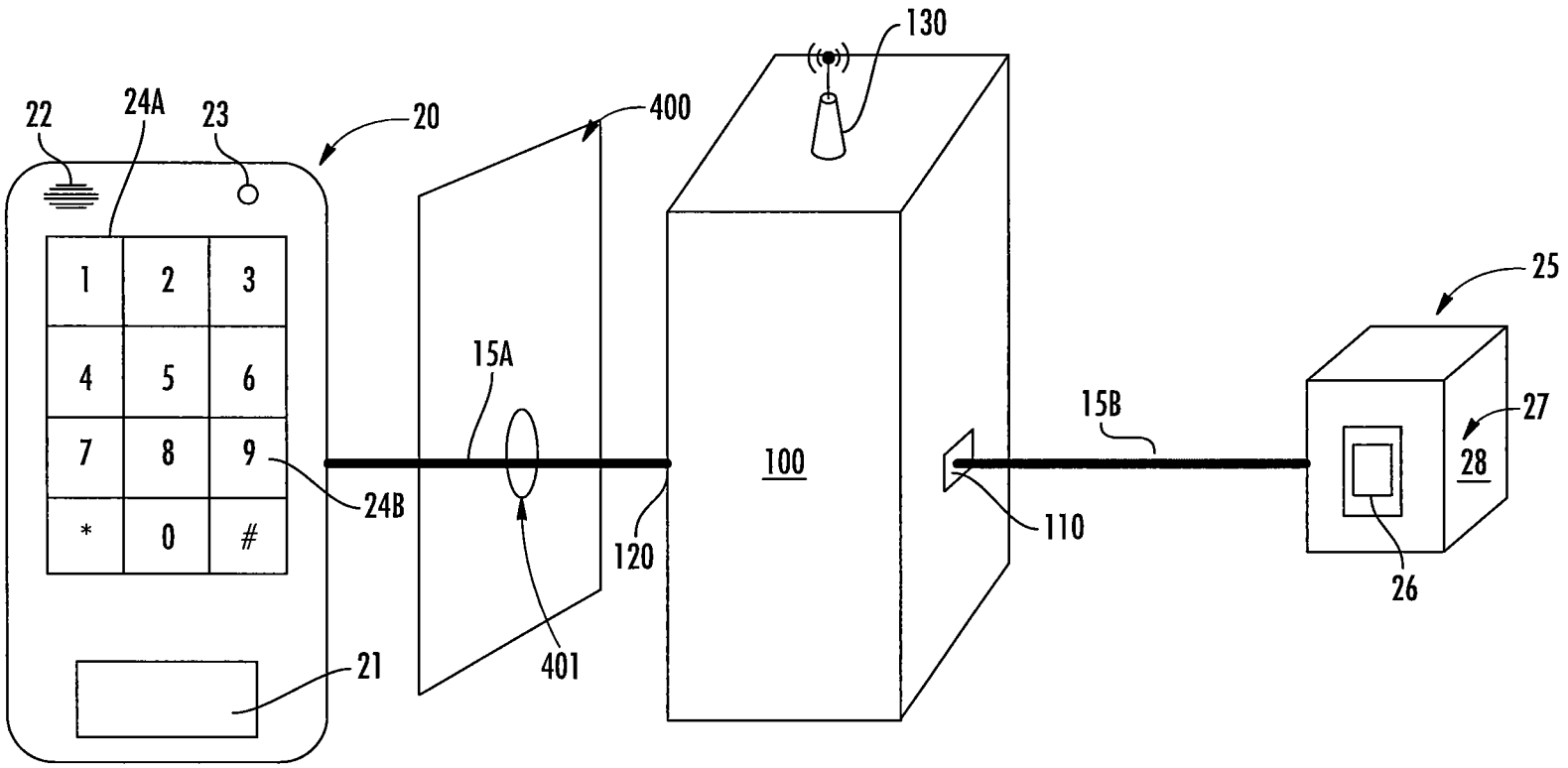
FIG. 3 illustrates an exemplary arrangement of a lock, keypad, and network connectivity module according to aspects described herein.

FIG. 2 is a block diagram of a network connectivity module 100 according to one or more aspects of the present disclosure, and FIG. 3 illustrates how a network connectivity module 100 may be added to the exemplary lock and keypad environment of FIG. 1. The network connectivity module 100 may be referred to herein as a module 100. Module 100 may have a lock port 110, a keypad port 120, and an input/output interface 130. The module 100 may include one or more processors 101, which may execute instructions of a computer program to perform any of the features described herein. The instructions may be stored in any type of computer-readable medium or memory, to configure the operation of the processor 101. For example, instructions may be stored in a read-only memory (ROM) 102, random access memory (RAM) 103, removable media 104, such as a Universal Serial Bus (USB) drive or any other desired storage medium. When a removable media is used, a removable media interface (not shown) may be included in the module. Instructions may also be stored in an attached (or internal) hard drive 105, which may be a Flash drive. The module 100 may also be connectable, temporarily or permanently to one or more user input devices (not shown), such as a remote control, keyboard, mouse, touch screen, microphone, etc. The module 100 may also be connectable, temporarily or permanently to one or more output devices (not shown), such as a display, touch screen, monitor, speaker, or other output device (which may be a component of the module 100, a component of the securable container 400, or another local or remote output device). In some aspects, input and output to the module 100 may include formulating a wired or wireless connection to one or more other devices. For example, module 100 may connect to a smart phone device or tablet device (not shown) via a wired or wireless connection, and a user may provide inputs for configuring the module 100 via the smart phone device or tablet device.

Figure 4:
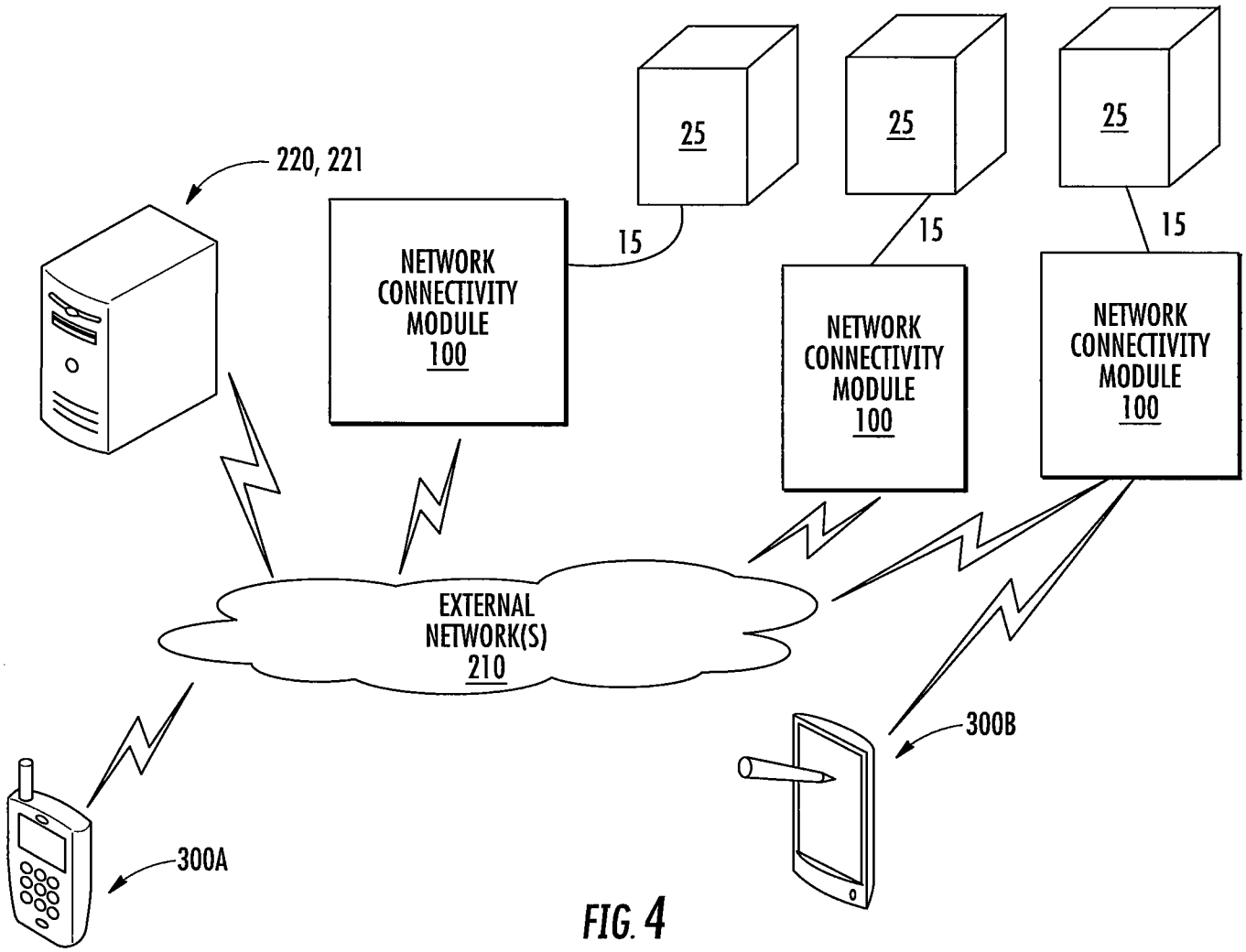
FIG. 4 illustrates an exemplary diagram of a networking environment in which a network connectivity module may be provided, according to aspects described herein.

With reference to both FIG. 2 and FIG. 4, which illustrates an exemplary network environment according to one or more aspects of the present application, the module 100 may also include one or more network interfaces, such as a network input/output (I/O) interface 130 to communicate with an external network 210. The input/output interface 130 may be a wired interface, wireless interface, or a combination of the two. In some embodiments, the network input/output interface 130 may include a modem and the external network 210 may include an in-home network, a provider's wireless, coaxial, fiber, or hybrid fiber/coaxial distribution system, a Wi-Fi or Bluetooth network, or any other desired network. External network 210 may be made up of one or more subnetworks, each of which may include interconnected communication links of various types, such as coaxial cables, optical fibers, wireless links, and the like. External network 210 and/or the subnetworks thereof may include, for example, networks of Internet devices, telephone networks, cellular telephone networks, fiber optic networks, local wireless networks (e.g., WiMAX, Bluetooth), satellite networks, and any other desired network, and the network interface 130 may include the corresponding circuitry needed to communicate on the external networks 210, and to other devices on the network such as a cellular telephone network and corresponding cellular telephone devices.

Module 100 may communicate via external network 210 with a central location server 220. The central location server 220 may also include one or more network interfaces 221, which can permit the central location server 220 to communicate with various other modules 100 via various other external networks 210. The components illustrated in FIG. 2 (e.g., processor 101, ROM storage 102) may be implemented using basic computing devices and components, and the same or similar basic components may be used to implement any of the other computing devices and components described herein, such as the central location server 220. For example, the various components herein may be implemented using computing devices having components such as a processor executing computer-executable instructions stored on a computer-readable medium, as illustrated in FIG. 2. In certain examples, the central location server 220 may communicate with one or more modules 100 at remote locations (e.g., homes, businesses).

Modules 100 may also be inter-connected to one or more external computing devices 300A, 300B, which may allow users to locally view, modify, and configure the modules 100. For example, modules may be disposed within a securable container at a first location, and may transmit data to the central location server 220 via a networking device (such as a router and/or modem) located relatively near the securable container (e.g., within 250 meters of the securable container).

Exemplary embodiments of an external computing device 300 may include devices configured to transmit and/or receive data from the central location server 220 or other remote network location (including network connectivity module 100). In addition to receiving information from the central location server 220, the external computing devices 300 may also have the ability to receive information from a multitude of information sources. For example, the external computing devices 300 may also receive information regarding via GPS, cellular towers, the Internet, and so on. External computing devices may include various user input interfaces and a display screen which may be a touch screen. External computing devices 300 may be for example cell phones, smartphones, tablets, netbooks, laptops, or desktops. External computing devices 300 may include an Ethernet controller, Wi-Fi receiver, or Bluetooth technology.

In some aspects, central location server 220 may be optional, and external computing devices 300 may connect directly to a module 100. In some aspects, a central location server 220 and an external computing device 300 may be implemented in a computing device that performs the functionality of both components, which will be discussed further below.

Returning now to FIG. 2 and FIG. 3, and discussion of the module 100, as previously presented a lock port 110 and a keypad port 120 may be provided. During installation, an installer may connect the module 100 to a lock (e.g., lock 25) via a first set of conductors (which may be components of a cable 15B) connected to the lock port 110. The installer may connect the module 100 to a keypad (e.g., keypad 20) using a second set of conductors (which may be components of a cable 15A) connected to the keypad port 120. In other words, and with reference to FIG. 3, two cables 15A, 15B may be used to connect module 100 to keypad 20 and lock 25. Each of the cables 15A, 15B may have a number of conductors expected by the keypad and the lock. For example, as discussed above, some locks and keypads may require four conductors. Therefore, to connect a module 100 to these locks and keypads, two cables 15A, 15B may each have four conductors. In other words, a module 100 may be installed between a keypad 20 and a lock 25.

To install the module 100, a multi-conductor cable 15 that normally connects a lock 25 and a keypad 20 may be disconnected. The disconnected end is then connected to the module 100 and an additional cable 15, which may be supplied with the module 100, is then installed. For example, with some locks, the multi-conductor cable 15 will be disconnected at the lock 25, and that connection will be plugged into the module 100 (so the module 100 and keypad 20 are connected). The new cable 15 will then connect between the module 100 and the lock 25.

The module 100 may then be connected to an external network or networks, such as the Internet, either by a wired connection (e.g., an Ethernet connection) or wirelessly (e.g., a Wi-Fi connection). In other words, as discussed above, the I/O interface 130 may include a wired network interface or a wireless network interface. The module 100 may be powered over the wired network connection, by the lock power source (e.g., batteries or power supply), or by a separate power supply.

Figure 5:
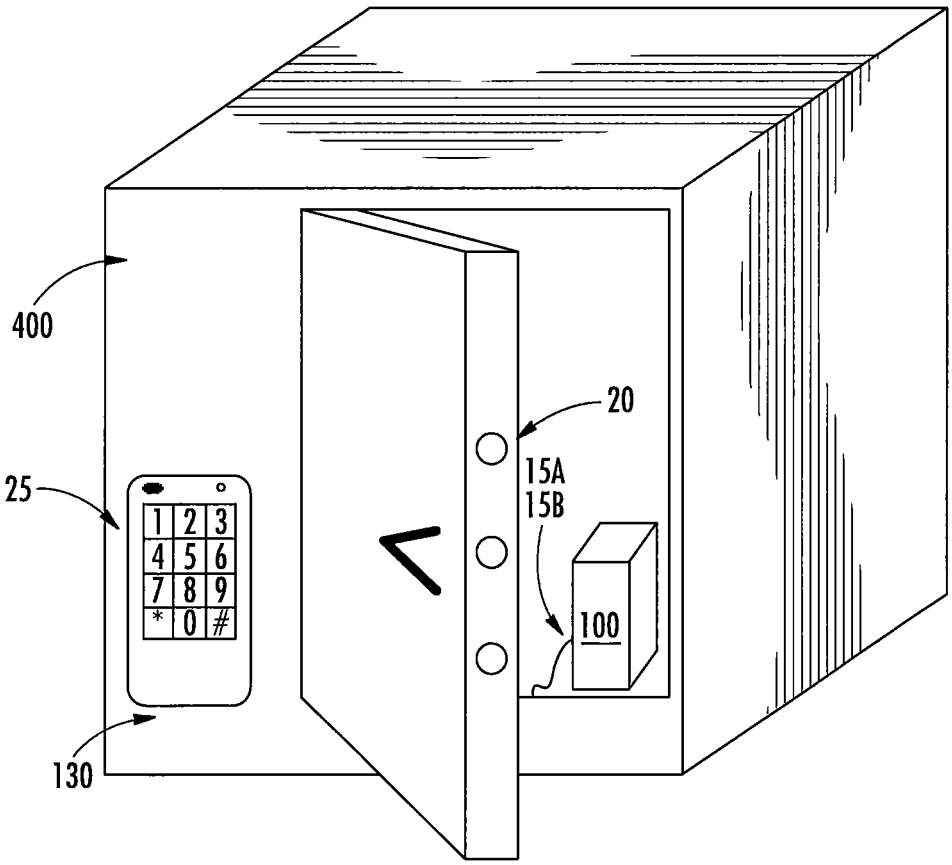
FIG. 5 illustrates an exemplary arrangement of a network connectivity module relative to a securable container, according to one or more aspects described herein.

FIG. 5 illustrates an example installation of a module 100 relative to a securable container 400. Although the module 100 is illustrated as being installed within the securable container 400, the module may be installed inside or outside the container, or a combination of both. For example, if the module 100 connects to an external network by way of a wireless connection, the module (or a component thereof) can be mounted on the outside of the securable container 400 under the keypad (between the keypad and a door of the securable container), or adjacent to the keypad. If the module connects via a wired connection, it may be mounted outside the securable container 400 or inside the securable container 400, depending on the customer's preference. For example, an additional hole may be manufactured or drilled into a wall of the securable container to provide ingress for a cable for the wired connection. If the module 100 is used in a way to provide increased lock functionality (as opposed to just providing a network connection e.g., to record access attempts) it is envisioned that the module be installed inside the container to prevent unauthorized tampering. It is envisioned that a wirelessly connected unit may have a wireless antenna in a sub-module on the outside of the container, but components of the module containing security related operations are placed in the secured area of the container.

Although the module 100 is installed near a sidewall of the securable container 400, in FIG. 5, such installation location is merely exemplary, and the module may be installed on or near a ceiling, floor, sidewall, back wall, front wall, or door of the securable container. The module 100 may be secured, affixed, mounted, glued, taped, screwed into, or otherwise fastened to the securable container at the installation location.

Figure 6:
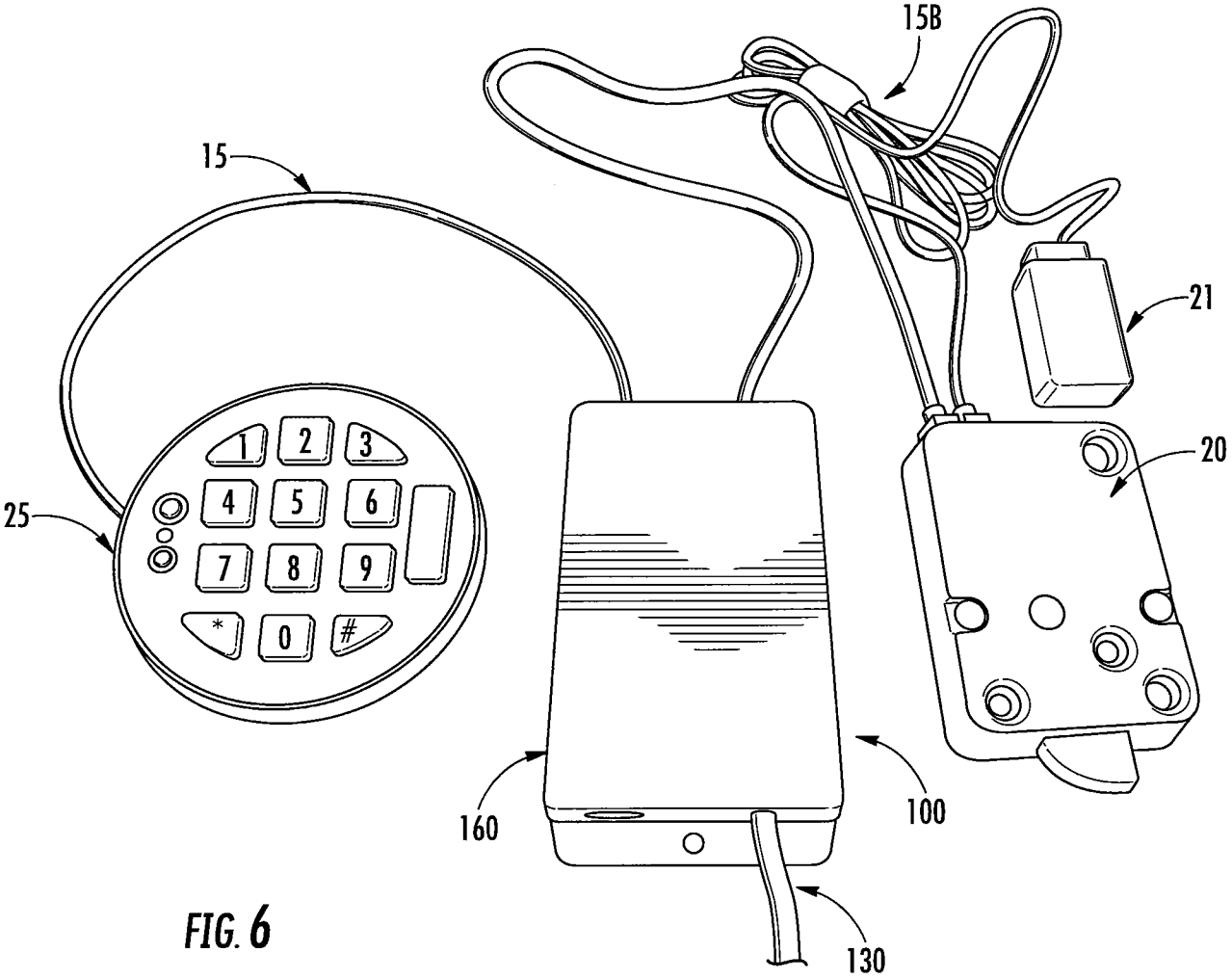
FIG. 6 illustrates exemplary prototypes of the network connectivity module, according to aspects of the present disclosure.

FIG. 6 illustrates various aspects of a prototype module 100 according to one or more aspects herein. FIG. 6 illustrates protective housing 160 of the module, which may be formed from metal, thermoset resins, and/or thermoplastic resins. Components depicted in FIG. 6 are referred to by reference numerals which correspond to components depicted in FIGS. 1-3, and provide similar functionality to that discussed above.

Turning now to a discussion of the functionality of a network connectivity module 100, the module 100 or more specifically a processor of module 100, may receive signals or indications of signals, such as indications of voltage signals, which are being communicated from the keypad 20 toward the lock 25, or from the lock 25 toward the keypad 20. Additionally or alternatively, module 100 may generate signals, including voltage signals, and direct the generated voltage signals toward the keypad 20 and/or the lock 25.

Module 100 may decode the signals it receives from the keypad 20 and/or the lock 25. For example, as discussed above, when a user presses a key (e.g., key 24A) the keypad 20 may generate and send to the lock an analog or digital voltage signal. This analog or digital voltage may be received at the module 100 via the keypad port 120, and the voltage signal may be decoded to determine which key the user pressed. This decoding may be based on information about the lock manufacturer and/or lock model number, which may be received by the module 100 during installation of the module 100, or at a later time. The module 100, or more specifically a memory of the module 100 may include a decoding library, decoding table, and/or a set of decoding instructions, which may be organized based on manufacturer and/or model number. In FIG. 2, a decoding library 106 is shown as part of RAM 103, but of course it may be stored in one or more other memories of the module 100. The decoding library, decoding table and/or decoding instructions may be updatable over time (e.g., the module 100 may receive updates, such as periodic updates, with new or updated decoding instructions for existing lock models or lock manufacturers, or new decoding instructions for new lock models or lock manufacturers). For example, it has been observed that various lock models from different manufacturers may have different communication protocols. In some aspects, a memory device of the module may contain a library for each type of connected lock.

The module 100, or more specifically a memory of the module 100 may, additionally or alternatively include an encoding library, encoding table, and/or a set of encoding instructions, which may be organized based on manufacturer and/or model number. This encoding library may be stored RAM 103, but of course it may be stored in one or more other memories of the module 100. The encoding library, encoding table and/or encoding instructions may be updatable over time (e.g., the module 100 may receive updates, such as periodic updates, with new or updated encoding instructions for existing lock models or lock manufacturers, or new enoding instructions for new lock models or lock manufacturers). The decoding library and the encoding library may be the same library in some aspects.

Module 100 may forward the received voltage signal on toward the lock 25 via the lock port. This may occur contemporaneously with the decoding of the signal by the module 100 using the decoding library, or after the signal has been decoded. In some aspects, the module 100 may substitute the signal received from the keypad 20 and transmit a different signal, which may be a signal encoded using the encoding library, toward the lock 25.

An example use case of decoding and encoding signals may be where a lock at a securable container is configured to only receive one combination (e.g., 1-2-3-4). An operator of the lock 25, keypad 20, and module 100 would like to employ multiple combinations for security and logging purposes. Accordingly, a first user may receive a combination of 2-4-6-8 and a second user may receive a combination of 3-5-3-9. Each of these users may need access to the securable container.

Rather than install a new lock that can receive multiple combinations, or provide the 1-2-3-4 combination to both of the first user and the second user, the operator may install a module 100 at the securable container and connect it to both the lock and keypad. The operator may indicate the model number and/or manufacturer of the lock and keypad, enable a "multiple combinations" setting within the module 100, and indicate that combinations 2-4-6-8 and 3-5-3-9 are acceptable. Details of configuring the module 100 will be discussed further below.

Continuing with an example use case, the first user may arrive at the securable container and enter into the keypad her combination (2-4-6-8). The module 100 may receive signals corresponding to these keypresses and decode the signals. The module 100 may determine that the combination is acceptable, and may generate and transmit signals which are understood by the lock as signals corresponding to 1-2-3-4 keypresses. The lock accepts this combination and permits access to the securable container. Similarly, the second user may arrive later at the securable container and enter into the keypad her combination (3-5-3-9). The module 100 may receive signals corresponding to these keypresses and decode the signals. The module 100 may determine that the combination is acceptable, and may generate and transmit signals which are understood by the lock as signals corresponding to 1-2-3-4 keypresses. The lock accepts this combination and permits access to the securable container. Therefore, the lock, although not originally provided with "multiple combinations" functionality, may be "upgraded" by installing a module 100 and connecting it to the lock. The module 100 may be said to act as an intermediary. To further the example use case, the module 100 may store the access attempts of the first user and the second user and transmit them toward the central location server 220 and/or the external computing devices 300, providing the desired functionality of the operator (which was also not originally provided by the lock and keypad).

As another example of adding new functionality to a lock, the original lock installed at a location might not include a time lock function. Installation of a module 100 may allow for the addition of a time lock function. The operator may indicate the model number and/or manufacturer of the lock and keypad, enable a "time lock" setting within the module 100, and indicate when access to the securable location is permitted. In this configuration, the module handles all the functions normally handled by the lock and may sends the lock an opening code only when during the permitted access time.

In some aspects, the module does not necessarily interfere with the normal stand-alone operation of the lock. For example, a user in the example above may provide at the keypad the combination 1-2-3-4. The combination may be transmitted to the lock, which provides access. It is considered that a user located at the physical location of the container may still operate the lock as normal, and might not be aware of the module that is connected to the lock.

In some aspects, as discussed above a lock may provide feedback information by driving a beeper, LED, or other feedback device in the keypad. The module 100 may receive these feedback signals, or indications of these feedback signals, and decode the feedback data. These feedback signals may be forwarded to the keypad, or more specifically to the beeper, LED, or feedback device, and may also be transmitted to a remote device via I/O interface 130. In some aspects, the feedback information may be stored in a memory device of the module 100 for later accessing.

However, as discussed above, it is considered that some individuals or organizations may have locks from different manufacturers in the network of containers in a single location or multiple locations. For example, a bank may build new branch locations, or acquire a competitor through merger, and each branch location may have a different lock on its bank vault. Therefore, the module may provide a common operating interface, which may be accessible locally via a wired or wireless link and/or remotely via external networks 210. In this way, the customer might not need to remember the specific operating instructions for each lock type in the network. Operation of the lock locally and/or remotely may follow instructions provided with the module instead of the specific lock instructions. In this way, a customer may acquire locks from multiple suppliers, or multiple model types from a single supplier, and still have a common operating procedure regardless of the specific locks acquired.

The module 100 may be configurable to display graphic instructions on a display device of, for example, a securable container or a device associated with the securable container (e.g., a display device of an ATM, cash register, or so on). This may provide an operator or installer with security instructions or give technical troubleshooting feedback from the lock or keypad. This feedback information may include information such as entry of an incorrect code, status information about the lock and/or keypad (e.g., the lock is in a security lockout state, the combination has been changed, the lock is in time delay state, the keypad is not functioning correctly, or the like). This function may enable the operator to gain insight into why the lock is not properly functioning and may assist in providing service instructions to a service technician. In some aspects, the module 100 may communicate the status information or the information used in generating the graphic instructions via the I/O interface 130, so as to indicate the trouble or status information to the central location server 220 and/or external devices 300.

In some aspects, one or multiple modules 100 may be controlled remotely so as to access or provide functionality from a remote location (e.g., via inputs received at central location server 220 and/or external devices 300). As an example, consider one time code (OTC) applications, which were previously discussed. The module 100 may provide OTC functionality with greater flexibility than traditional stand-alone OTC locks. As one example, an OTC can be generated by central location server 220 and transmitted by a ATM service technician or vehicle (e.g., a cash carrier, a display device in an armored truck) via a text message based on an indication that the ATM service technician or vehicle is geographically proximate to a module 100. The OTC may also be communicated to the module 100 based on this indication. In some aspects, the module 100 may require the service technician enter a authorizing code unique to the service technician at the keypad 20. This may be transmitted by the module 100 via I/O interface 130 and external network 210 to central location server 220, and read and approved by the central location server 220 and/or an authorizing agent (e.g., via an external device 300) before the central location server may issue the OTC. In some aspects, the service technician may be able to enter a duress authorization code to notify secretly to the dispatch office that he is being forced by an unauthorized person to open the safe. In some aspects, a still or video camera may be located proximate to the securable container, and may transmit an image of the service technician to the central location server, where it may be reviewed automatically or by the authorizing agent.

As another example, natural or man-made disasters (e.g., riots, hurricanes, floods, blizzards, terrorism, or the like) may disrupt activities across a city, state, or region. The disrupted activities may include retail or banking activities. However, locks protecting securable containers at these locations may operate on time-delay or time-access modes, where the locks are disabled and access to the securable containers is provided during certain times of day. An owner or operator of securable containers across the city, state, or region may need to visit each site and disable time-delay or time-access modes, which may be difficult during the natural or man-made disasters) because of road closures or adverse conditions. Accordingly, the owner or operator may access modules 100 within the city, state, or region and disable the functionality (and/or enable alternative functionality) during the crisis. In some aspects, the owner or operator may access the modules 100 via a standalone application installed on external devices 300, and/or via a Web site hosted by a server in communication with the central location server 220.

In some situations, inputs from both the lock port 110 and the keypad port 120 must be interpreted in combination. For example, consider a use case where a module 100 is instructed, either locally or remotely, to delete a code stored in the lock. Module 100 may first generate or receive a sequence of analog voltage levels which, from the perspective of the lock, is a key press sequence to delete the code. The module may first produce the same analog voltage levels in conjunction with the specific lock without interfering with the normal key presses from the keypad. Second, the module may interpret the beeper feedback from the lock to determine the state of the lock. For example, the module 100 may interpret the lock feedback for each key press to determine if each key press signal was accepted by the lock. The module 100 may then interpret the resulting feedback pattern to determine if the code deletion was accepted and executed by the lock.

As discussed previously, some locks may be self-powered using a stepper motor as a generator. These locks may require sufficient energy to be stored on capacitors before the lock will accept any key press data from the keypad. The lock typically monitors the capacitor voltage and specific communication signals from the keypad to determine when the keypad data will be accepted. In some aspects, therefore, the module 100 may be configured to simulate a user quickly turning a dial back and forth repetitively. This simulation may include, for example, providing a voltage sequence to the lock.

As discussed above, an observed benefit of the module 100 is that it may be able to add features to a lock that were not originally included with that lock. For example, if the original lock purchased by the customer did not include a time lock function, the module 100 may be programmed to "add" the time lock function. In some aspects, the module may incorporate multiple features desired by the customer regardless of the lock. The module may handle inputs the functions normally handled by the lock and simply sends the lock an opening code only when the lock should open. All features like time lock, time delay, penalty time, operating mode, remotely enable and disable lock operation, etc. are handled by the module. Exemplary features which may be controlled by the module (e.g., additional functionality that may be added to a lock by installation of the module) include the following, which are provided herein as examples only. Any number of non-mutually exclusive features provided below may be enabled or disabled in unison.

Increased Number of Independent user codes: each user may be provided with a unique combination or code. The user may enter the code at the lock and the module may decode the entered code. The module may then transmit a common unlocking code to the lock if the entered code is acceptable. In some aspects, the memory may be configured to store up to fifty different unique combinations, although the disclosure is not limited to that specific number.

Single User Mode: only one valid user code is needed to unlock the lock. A single user may enter a common or unique code at the lock and the module may decode the entered code. The module may then transmit an unlocking code to the lock if the entered code is acceptable.

Dual User Mode: multiple user codes are needed to unlock the lock. A first user may enter her code at the lock and the module may decode the entered code. A second user may enter his code at the lock and the module may decode the entered code. The module may then transmit an unlocking code to the lock if the entered codes are both acceptable.

Supervisor/Employee Mode: A supervising user may enter her code at the lock and the module may decode the entered code. Later, an employee user may enter his code at the lock and the module may decode the entered code. The module may then transmit an unlocking code to the lock if the entered codes are both acceptable.

Allow External Input to Enable or Disable the Lock Keypad From Communicating with the Lock Time Delay: A value may be set which may delay accessing of the securable container for a period of time after entry of an acceptable code or codes. In some aspects, this delay may be set to a value between one and one hundred minutes.

Opening Window: A value may be set which may be a time allotted after time delay has expired to allow the lock to be opened using a valid code or codes.

Duress or Hold Up Alarm: Enabling this setting may allow a user or users to enter a code or codes that will open the lock but send an alarm signal through the I/O interface of the module 100 to the central location server and/or to an alarm system.

Penalty Time Lockout Feature: Enabling this feature may prevent entry of more than a threshold number of incorrect codes before the lock will not recognize new code entry attempts.

Audit Trail: The module 100 may be configured to storage events entered through the lock keypad with a time and date stamped audit trail. Additional detail related to audit trail events (e.g., lock status, number of previous incorrect attempts, and so on) may added to assist management and security investigations.

Initial Configuration: The module 100 may be configured in some aspects to store an initial configuration (e.g., initial setup) of the module and lock system in a separate file. In some aspects, this configuration file may be accessed only with a high level manager code to ensure other features are not enabled/disabled after a total number of events stored in the audit trail are exceeded and initial setup conditions can no longer be accessed via the audit trail.

Incorrect Code Storage: In some aspects, the module 100 may store the incorrect codes entered in all wrong code attempts. This data may be analyzed by the module 100, central location server 220, and/or a user thereof to determine if an individual entering the incorrect codes is attempting to randomly determine codes.

One-Time-Code (OTC) generation: As discussed above, in some aspects, the module 100 may be configured to generate OTCs that enable access to the lock for a specific time of day and duration that the OTC is valid.

Time Lock: The module 100 may be configured to enable or disable access to the securable container based on multiple time frames (e.g., durations, periods) for each day of the week and on a weekly/monthly/yearly calendar. In some aspects, based on time lock settings, a lock and/or unlock voltage output may be transmitted to a remote stepper motor driven time lock movement that will lock a typical two or three movement time lock.

Error Code Interpretation: In some aspects, the module 100 may interpret the error code messages from each manufacturer's locks and provide troubleshooting of the lock system to a technician (either locally or remotely). Examples of such codes may include, for example; low battery, incorrect code entered, time delay running, opening window enabled, dual combination required, system in time lock condition, wrong code penalty, or other error indications specific to specific lock models.

Lock/Keypad Communication: In some aspects, the module 100 may accommodate keypad and lock connections which may be unique to a plurality of electronic locks manufactured. The module 100 may determine analog and digital communications to and from a plurality of manufacturer's locks and keypads and may be able to communicate with each system as needed.

Power: In some aspects, power may be provided to the lock 25 using the existing battery input for each style system or may be provided external power, such as power required by self-generating systems. In some aspects, this may be provided even in the absence of a person to rotate the dial to generate the power required by the lock.

Multiple Connections: In some aspects, the module 100 may be programmable to enable additional security monitoring of the locking system, such as boltwork condition (locked or unlocked) or safe door condition (locked or unlocked). As discussed above, in some aspects, the module 100 may be configured to activate a camera system on or before combinations are entered on the lock keypad.

Network Connectivity: In some aspects, the module 100 can be connected to the Internet or other networks and may be provided with a unique network address, such as an IP address. The module 100 may be remotely accessible through a monitoring software that may allow online management of the module system even if the locking system connected to the module does not have network capable features. In some aspects, the communication to and from the module 100 via the external network 210 may be encrypted.

Aspects of the present disclosure have been described above with reference to the accompanying drawings, in which embodiments of the present disclosure are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

What is claimed is:

1. A module configured to be installed between and connected to each of a locking device and a keypad, comprising:

a processor; and memory storing instructions that when executed by the processor, cause the processor to:

determine a set of features that the locking device and the keypad are programmed to perform; and execute at least one instruction to perform an additional feature that is not in the set of features and that the locking device and the keypad are not programmed to perform.

2. The module of claim 1, wherein the memory storing the instructions that cause the processor to execute the at least one instruction comprise instructions that cause the processor to transmit a signal toward the locking device.

3. The module of claim 2, wherein the signal comprises a first signal, and wherein the instructions that cause the processor to transmit the signal toward the locking device comprise instructions that cause the processor to:

receive a second signal from the keypad; and generate the first signal based on the second signal and based on data stored in the memory.

4. The module of claim 3, wherein the second signal indicates a press of a first key of the keypad, and wherein the first signal indicates a press of a second key of the keypad different from the first key.

5. The module of claim 2, wherein the instructions that cause the processor to transmit the signal toward the locking device comprise instructions that cause the processor to:

generate the signal based on data stored in the memory.

6. The module of claim 1, wherein the instructions that cause the processor to execute the at least one instruction comprise instructions that cause the processor to:

access a library stored in the memory; and retrieve the at least one instruction based on an indication of a manufacturer and/or an indication of a model of the locking device.

7. The module of claim 6, wherein the indication of the manufacturer and/or the indication of the model of the locking device are received during a setup process for the module and are stored in the memory.

8. A module configured to be installed between a locking device and a keypad, comprising:

a network interface;

a processor; and memory storing instructions that when executed by the processor, cause the processor to:

receive a command via the network interface, wherein the command indicates a feature that the locking device and the keypad are not programmed to perform independent of the module; and transmit a signal toward the keypad and/or the locking device based on the command and based on data stored in the memory.

9. The module of claim 8, wherein the signal comprises an indication of a simulated press of a first key of the keypad.

10. The module of claim 8, wherein the data stored in the memory comprises an indication of a manufacturer of the locking device and/or the keypad.

11. The module of claim 8, wherein the command is received from a location remote from the module.

12. The module of claim 8, wherein the instructions that cause the processor to transmit the signal comprise instructions that cause the processor to:

access a library stored in the memory; and retrieve instructions from the library based on an indication of a manufacturer and/or an indication of a model of the locking device.

13. The module of claim 8, wherein the command received via the network interface comprises a command to generate a one-time-code usable to unlock a securable container secured by the locking device.

14. A module configured to be installed between a locking device and a keypad, comprising:

a network interface;

a processor; and a memory storing a library comprising commands for locking devices manufactured by a plurality of manufacturers, the memory further storing instructions that when executed by the processor, cause the processor to:

receive a command via the network interface requesting performance of a feature;

access the library to retrieve at least one first instruction that is selected based on an indication of the feature and an indication of a manufacturer of the locking device; and perform the feature, wherein performing the feature comprises executing the at least one first instruction, wherein the library comprises at least one second instruction for a different manufacturer that, if executed, performs the feature.

15. The module of claim 14, wherein executing the at least one first instruction comprises generating a signal simulating a pressing of a first key of the keypad and transmitting the signal toward the locking device.

16. The module of claim 14, wherein the command indicates a feature that the locking device and the keypad are not programmed to perform independent of the module.

17. The module of claim 14, wherein the indication of the manufacturer of the locking device is received during a setup process for the module and is stored in the memory.

18. The module of claim 14, wherein the command is received from a location remote from the module.

19. The module of claim 14, wherein the instructions that cause the processor to perform the feature comprise instructions that cause the processor to:

receive an indication of a signal from the keypad; and generate a second signal based on the signal from the keypad and based on data stored in the memory.

20. The module of claim 19, wherein the signal from the keypad indicates a press of a first key of the keypad, and wherein the second signal comprises an indication of a simulated press of a second key of the keypad different from the first key.

* * * * *